US010280600B2

(12) United States Patent
Tempel

(10) Patent No.: US 10,280,600 B2
(45) Date of Patent: May 7, 2019

(54) JET REGULATOR

(71) Applicant: NEOPERL GMBH, Mullheim (DE)

(72) Inventor: Marc Tempel, Freiburg (DE)

(73) Assignee: Neoperl GmbH, Müllheim (DE)

( * ) Notice: Subject to any disclaimer, the term of this patent is extended or adjusted under 35 U.S.C. 154(b) by 804 days.

(21) Appl. No.: 14/403,472

(22) PCT Filed: Aug. 21, 2013

(86) PCT No.: PCT/EP2013/002520
§ 371 (c)(1),
(2) Date: Nov. 24, 2014

(87) PCT Pub. No.: WO2014/067594
PCT Pub. Date: May 8, 2014

(65) Prior Publication Data

US 2015/0102133 A1 Apr. 16, 2015

(30) Foreign Application Priority Data

Nov. 2, 2012 (DE) ..... 20 2012 010 420 U

(51) Int. Cl.
*E03C 1/08* (2006.01)
*E03C 1/084* (2006.01)
*E03C 1/086* (2006.01)

(52) U.S. Cl.
CPC ..... *E03C 1/084* (2013.01); *E03C 1/08* (2013.01); *E03C 1/086* (2013.01)

(58) Field of Classification Search
CPC . E03C 1/08; E03C 1/084; E03C 1/086; Y10S 261/22
(Continued)

(56) References Cited

U.S. PATENT DOCUMENTS 4,000,857 A * 1/1977 Moen ..... B05B 1/3006 137/860
4,562,960 A * 1/1986 Marty ..... E03C 1/084 138/45
(Continued)

FOREIGN PATENT DOCUMENTS

CA 2647917 A1 6/2010
DE 3000799 A1 7/1981
(Continued)

*Primary Examiner* — Alexander M Valvis
*Assistant Examiner* — Christopher R Dandridge
(74) *Attorney, Agent, or Firm* — Volpe and Koenig, P.C.

(57) ABSTRACT

A jet regulator (100) including a jet regulator housing (2) is disclosed, in the housing interior of which a perforated plate (5) is provided with a plurality of flow-through holes (6) for dividing the through-flowing water. The jet regulator described is characterized in that at least one flow-through hole (6) extends conically towards its outflow side in at least one outflow-side hole section. It is also possible for flow obstacles to be provided on the outflow side of the perforated plate (5) in the jet regulator housing (2) and/or on the outflow front face of the jet regulator housing, which are arranged or concentrated there in a central or middle region and which deflect the through-flowing water into an outer annular zone. This jet regulator (100) enables an aerated and thereby sparkling-soft water jet to be generated even with low flow-through performance and low water pressure.

20 Claims, 7 Drawing Sheets

(58) Field of Classification Search
USPC ..... 239/428.5; 261/116, DIG. 22, 428.5; 4/541.6
See application file for complete search history.

(56) References Cited

U.S. PATENT DOCUMENTS

| | | | | |
|---|---|---|---|---|
| 5,071,071 | A * | 12/1991 | Chao | E03C 1/084 239/428.5 |
| 8,308,079 | B2 | 11/2012 | Grether et al. | |
| 2003/0029935 | A1* | 2/2003 | Takeshi | B05B 7/005 239/428.5 |
| 2008/0115841 | A1* | 5/2008 | Ruhnke | G05D 7/0133 137/492.5 |
| 2010/0163478 | A1* | 7/2010 | Yuan | B01D 36/04 210/251 |

FOREIGN PATENT DOCUMENTS

| | | | |
|---|---|---|---|
| DE | 9414686 | U1 | 11/1994 |
| DE | 102006057795 | B3 | 2/2008 |
| EP | 1273724 | A1 | 1/2003 |
| GB | 1485430 | | 9/1977 |
| WO | 2006005099 | A2 | 1/2006 |

* cited by examiner

JET REGULATOR

BACKGROUND

The invention relates to a jet regulator having a jet regulator housing, in the housing interior of which there is provided a perforated plate which has a multiplicity of throughflow holes for dividing the through-flowing water.

Jet regulators of the type mentioned in the introduction are already known in a wide variety of embodiments. Jet regulators of said type are mounted on the water outlet of a sanitary outlet fitting in order to generate a homogenous and laterally non-sputtering water jet. Jet regulators also exist which aerate the out-flowing water jet and, for this purpose, are designed to mix the through-flowing water with the ambient air.

For example, from DE 30 00 799 A1, an aerated jet regulator is already known which, in its jet regulator housing, has a perforated plate with a multiplicity of throughflow holes which are arranged in concentric hole circles on the perforated plate and which are intended to split up the water—flowing through the jet regulator housing into a corresponding number of individual jets. Since the throughflow holes constrict the clear throughflow cross section in the region of the perforated plate, the through-flowing water increases in speed in the throughflow holes, which, in accordance with the Bernoulli equation, results in a negative pressure on the outflow side of the perforated plate. Due to the negative pressure generated on the outflow side of the perforated plate, ambient air is drawn in, which ambient air can enter into the housing interior of the jet regulator housing through aeration openings provided in the housing wall and can mix there with the through-flowing water. In order that the through-flowing water is divided into individual jets by means of the perforated plate in a quiet manner, it is provided in the case of the jet regulator already known from DE 30 00 799 A1 inter alia that the throughflow holes have a hole section which is polygonal in cross section, downstream of which hole section there is provided a hole section which widens progressively in terms of cross section and which is cylindrical at the outflow side (see FIG. 4 in DE 30 00 799 A1). By means of throughflow holes of said type which have different sections, an individual jet which is of circular cross section and which flows out linearly is produced in each of the throughflow holes.

EP 1 273 724 B1 (=DE 601 01 909 T2) has already disclosed a jet regulator having a jet regulator housing, in the housing interior of which there is provided a perforated plate with throughflow holes which have a clear cross section which remains constant in the throughflow direction. Positioned downstream of the perforated plate in the throughflow direction is an impingement cone which forms a constriction in the throughflow cross section of the already known jet regulator. The individual jets generated in the perforated plate can entrain the ambient air in the housing interior of the jet regulator housing, and subsequently impinge on the oblique surface of the impingement cone such that the aerated individual jets with the entrained air are broken up and thoroughly mixed.

The already known jet regulators however require a certain throughflow rate and an adequate water pressure in the supply main network in order for there to be generated on the outflow side of the perforated plate, which serves as a jet splitter, a negative pressure sufficient to draw ambient air into the housing interior of the jet regulator housing. By contrast, the negative pressure generated in the case of a low throughflow rate and low water pressures is normally not sufficient to mix the ambient air with the through-flowing water.

SUMMARY

It is therefore the object to provide a jet regulator of the type mentioned in the introduction which, even in the case of a low throughflow rate and/or low water pressures, such as are commonly desirable for example also for water-saving purposes, can generate an adequately aerated and accordingly sparkling, soft water jet. Here, it is also sought to generate as voluminous a jet as possible which, for the user, does not differ visually and haptically from the familiar prior art, wherein the jet regulator according to the invention should preferably be interchangeable with known jet regulator designs.

This object is achieved according to the invention, in the case of the jet regulator of the type mentioned in the introduction, in particular in that at least one throughflow hole widens in a tapered or conical manner toward its outflow side.

The jet regulator according to the invention has a jet regulator housing, in the housing interior of which there is provided a perforated plate which extends, for example, over the housing cross section. The perforated plate has a multiplicity of throughflow holes which are designed for splitting up the through-flowing water. At least one of the throughflow holes provided in the perforated plate widens toward its outflow side, and preferably progressively in tapered or conical fashion as far as the outflow side. Due to the tapered or conical spreading of the water emerging from the perforated plate, mixing of said water with the ambient air drawn into the jet regulator housing is possible practically over the entire housing cross section of the jet regulator housing even in the case of low throughflow rates and low water pressures.

Here, the effective mixing of air with the through-flowing water is additionally promoted, even in the case of low throughflow rates and low water pressures, if at least one throughflow hole widens in a tapered or conical manner toward its outflow side such that the individual jet which emerges from the throughflow hole, and which widens due to the tapered shape or the conicity, mixes in the housing interior with the individual jet of at least one adjacent throughflow hole preferably before the individual jets impinge on at least one jet-forming part arranged in the housing interior.

In addition to or instead of the widening of at least one throughflow hole in a tapered or conical manner, a further proposal according to the invention which is independently worthy of protection provides, in the case of the jet regulator of the type mentioned in the introduction, that on the outflow side of the perforated plate, flow obstructions are provided in the jet regulator housing and/or on the outflow face surface of the jet regulator housing, which flow obstructions are arranged or concentrated there in a central or middle region and divert the through-flowing water into an outer annular zone which, by contrast, has no flow obstructions or a smaller number or total area of flow obstructions. To provide the jet regulator with a jet regulator housing which, for compatibility reasons, corresponds in terms of its dimensions to the dimensions of commercially available jet regulators, and to nevertheless even in the case of low throughflow rates form a water jet which appears similarly voluminous in cross section, the through-flowing water is, by means of the flow obstructions, at least partially also diverted from a central or middle region into an outer annular zone which forms the outer circumference of the emerging water jet.

An advantageous exemplary embodiment of the invention provides that, on the outflow side of the perforated plate and at a distance from the latter, there is provided on the housing inner circumference an encircling impingement bevel which narrows the clear housing cross section in said region progressively in the flow direction. In the case of this advantageous embodiment, the water which emerges from the throughflow holes and which has already been enriched with air impinges, at a distance downstream of the perforated plate, on an impingement bevel by means of which the water already thus treated is additionally mixed and split up, before the water thus enriched with air can emerge from the jet regulator as a homogenous, non-sputtering and sparkling, soft water jet.

An embodiment of the invention which is particularly easy to produce provides that the impingement bevel forms the inflow side of a wall section which is formed as at least one constriction which undulates as viewed in longitudinal section.

Here, the impingement bevel may be in the form of a protuberance on the inner circumference, or projection on the inner circumference, of the housing circumferential wall, and may be integrally connected to the jet regulator housing or to a jet regulator housing part.

What is preferable, however, is an embodiment in which the impingement bevel is formed as a wall section of an annular or sleeve-shaped insert part that can be inserted into the jet regulator housing.

In order also that at least one jet-forming part can be inserted into the housing interior of the jet regulator housing even if the perforated plate, which serves as a jet splitter, is formed integrally on the jet regulator housing, it is advantageous for the jet regulator housing to be of multi-part form and to have at least two housing parts which are preferably detachably connectable to one another.

Here, particularly advantageous embodiments of the invention provide that the impingement bevel is formed integrally on the housing inner circumference of an outflow-side housing part, and/or that the perforated plate is formed integrally in the housing interior of an inflow-side housing part.

In addition to or preferably instead of an impingement bevel, it is possible for at least one mesh or grate structure to be positioned downstream of the perforated plate as viewed in the flow direction. The water which emerges in tapered or conical form from the throughflow holes and which impinges on the at least one mesh or grate structure is slowed there and dispersed with the adjacent split-up parts of the water emerging from the adjacent throughflow holes, before subsequently emerging from the jet regulator as a soft overall jet.

Although a grate structure of said type may also be formed by an inserted metal screen which is formed from two sets of metal wires interwoven preferably at right angles to one another, an embodiment is preferable in which the mesh or grate structure is formed from two sets of webs which intersect one another at intersection nodes. Such a mesh or grate structure formed from two sets of webs which intersect one another at intersection nodes can be produced in a simple manner even as a plastic injection-molded part.

Here, a preferred embodiment of the invention provides that the at least one mesh structure positioned downstream of the perforated plate as viewed in the flow direction is formed from radial webs and from concentric webs which intersect said radial webs at intersection nodes.

To yet further promote the splitting-up of the water passing from the perforated plate, it may be advantageous for at least two mesh or grate structures which are spaced apart from one another to be positioned downstream of the perforated plate as viewed in the flow direction.

Here, one preferred refinement of the invention provides that at least one throughflow hole is aligned, in the flow direction, with a radial web of one mesh structure and with a concentric web of an adjacent mesh structure.

The water that is split up in the perforated plate flows out of the throughflow holes of the perforated plate less as an individual jet and more as a spray cone. To break up and divide up the spray cones emerging from the throughflow holes yet further, it is advantageous for the webs that are aligned in each case with a throughflow hole to overlap or intersect, in the flow direction of the at least one throughflow hole, in the different planes of said mesh or grate structures.

To make it possible for the jet regulator according to the invention to be produced with relatively little outlay for example from individual plastics parts, it may be advantageous for each mesh or grate structure to be formed by an insert part that can be inserted into the housing interior of the jet regulator housing.

Here, one preferred embodiment provides that each insert part has, on the outer circumference, an encircling annular wall on which webs of the mesh or grate structure are held and preferably integrally formed.

The breaking-up and splitting-up of the spray cones emerging from the throughflow holes of the perforated plate is further promoted if at least the concentric webs and preferably also the radial webs of an upstream mesh structure as viewed in the flow direction have an identical or smaller web thickness in relation to the webs of a mesh structure which is adjacent at the outflow side as viewed in the flow direction.

The throughflow holes provided in the perforated plate may be arranged on concentric hole circles. However, a preferred embodiment of the invention provides that the perforated plate has a central, hole-free impingement surface which is bordered by at least one annular wall, that the at least one annular wall has passage openings oriented in the radial direction, and that in each case one throughflow hole of the perforated plate is provided on that side of the throughflow openings which is arranged in the impingement surface plane. The water which, in this way, is diverted in the region of the annular wall is initially slowed, diverted to the side and mixed by way of partial flows—flowing toward one another, if appropriate in opposite directions, before said water can flow through the throughflow holes of the perforated plate and emerge, on the outflow side of the perforated plate, in the form of a corresponding number of spray cones.

In order that the water which is mixed with ambient air, and correspondingly made turbulent, in the housing interior of the jet regulator housing is formed into a homogenous overall jet again at the outflow side of the jet regulator, and in order that the water emerging from the jet regulator can be formed into a non-sputtering emerging water jet in an outflow-side homogenizing device, it is expedient if the outflow-side face surface of the jet regulator housing is formed by a mesh or honeycomb structure, and if the mesh or honeycomb structure that forms the outflow-side face surface is either non-detachably connected to, and in particular formed integrally with, the jet regulator housing or formed by an insert part that can be inserted into the jet regulator housing.

The homogenisation of the overall jet emerging from the jet regulator is further promoted if the mesh or honeycomb structure that forms the outflow-side face surface of the jet regulator housing is formed by webs which, at least in an outflow-side sub-region, narrow in the flow direction.

A preferred refinement of the invention provides that the jet regulator according to the invention is designed as an aerated jet regulator, into the housing interior of which there issues at least one aeration opening which connects the housing interior to the atmosphere. In order that the at least one aeration opening can connect the housing interior to the atmosphere, it is possible for at least one aeration duct which is designed to be open to the atmosphere to be provided in a double-walled sub-region of the jet regulator housing or in an annular gap bordering the jet regulator housing.

BRIEF DESCRIPTION OF THE DRAWINGS

Refinements of the invention will emerge from the claims in conjunction with the figures and the description of the figures. The present invention will be described in more detail below on the basis of preferred exemplary embodiments.

In the figures.

DETAILED DESCRIPTION OF THE PREFERRED EMBODIMENTS

Figure 1:
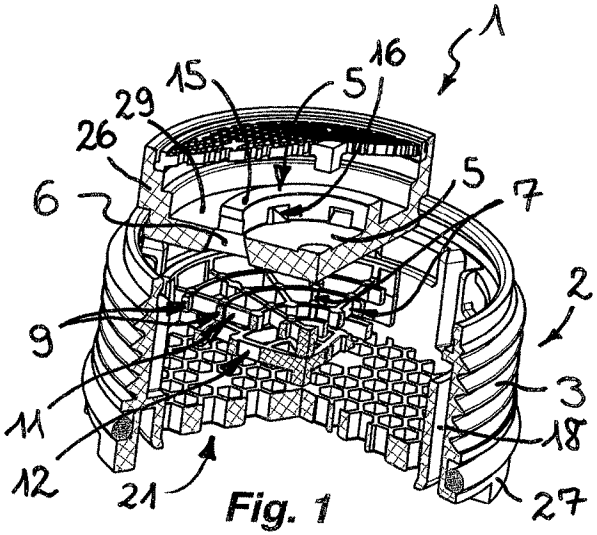
FIG. 1 shows, in a perspective partial longitudinal section, a jet regulator which, on the outer circumference of its jet regulator housing, bears an external thread by means of which the jet regulator can be detachably screwed into an internal thread on the water outlet of a sanitary outlet fitting.

FIGS. 1 to 13 show three exemplary embodiments 1, 10, 100 of a jet regulator. The jet regulator embodiments 1, 10, 100 are designed to be mounted on the water outlet of a sanitary outlet fitting in order to form a homogenous and laterally non-sputtering water jet there. In order that the water jet can emerge as a sparkling, soft water jet, the jet regulator embodiments 1, 10, 100 are in the form of aerated jet regulators in which the through-flowing water is mixed and enriched with ambient air.

The jet regulator embodiments 1, 10, 100 have a sleeve-shaped jet regulator housing 2 of circular cross section. The jet regulator embodiment 1 shown in FIGS. 1 to 5 has, on the housing outer circumference of the jet regulator housing 2, an external thread 3 which interacts with an internal thread arranged on the inner circumference of the water outlet of the outlet fitting (not shown in any more detail here). Here, the jet regulator embodiment 1 illustrated here can be screwed into the water outlet such that the outflow-side face surface of the jet regulator housing 2 is arranged practically in a plane with the outflow-side face edge of the outlet fitting.

By contrast, the jet regulator embodiments 10, 100 shown in FIGS. 6 to 13 are designed for being mounted on the water outlet of the outlet fitting by means of a sleeve-shaped outlet mouthpiece (not illustrated in any more detail here) after the jet regulator 10, 100 has been inserted, from the inflow-side sleeve opening of the outlet mouthpiece, into the sleeve interior of the latter until an annular shoulder 4 on the outer circumference of the jet regulator housing 2 lies against a support arranged on the inner circumference in the outlet mouthpiece.

In the housing interior of the jet regulators 1, 10, 100 there is provided a perforated plate 5 which bears a multiplicity of throughflow holes 6. At least one throughflow hole 6 and preferably all of the throughflow holes 6 of the perforated plate 5 widen in a tapered or conical manner toward their outflow side at least in an outflow-side sub-region. The throughflow holes 6 provided in the perforated plate 5 are designed for splitting up the through-flowing water. Due to the tapered or conical spreading of the water emerging from the perforated plate, mixing of said water with the ambient air drawn into the jet regulator housing is possible practically over the entire cross section of the jet regulator housing 2 even in the case of low throughflow rates and low water pressures.

Here, the throughflow holes 6 widen in a tapered or conical manner such that the water jet which emerges from the throughflow holes 6 and which widens due to the tapered shape or the conicity mixes in the housing interior with the individual jet of at least one adjacent throughflow hole before the individual jets impinge on at least one jet-forming part arranged in the housing interior.

To make it possible for the through-flowing water to be additionally split up and mixed with ambient air, it is the case in the jet regulator embodiments 1, 10 shown in FIGS. 1 to 6 that at least one, and preferably at least two, mesh structure(s) is/are positioned downstream of the perforated plate 2 in the flow direction, said mesh structure(s) being formed from radial webs 7 and from concentric webs 9 which intersect said radial webs at intersection nodes 8.

Figure 3:
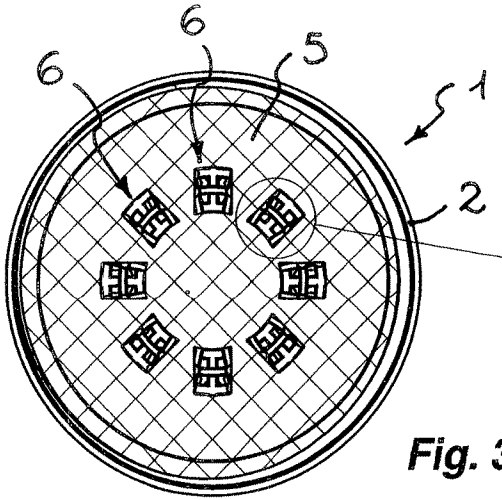
FIG. 3 shows the jet regulator from FIGS. 1 and 2 in a longitudinal section through section plane III-III from FIG. 2, wherein, through the throughflow holes of the transversely sectioned perforated plate, it is also possible to see the structures downstream of the perforated plate.
Figure 4:
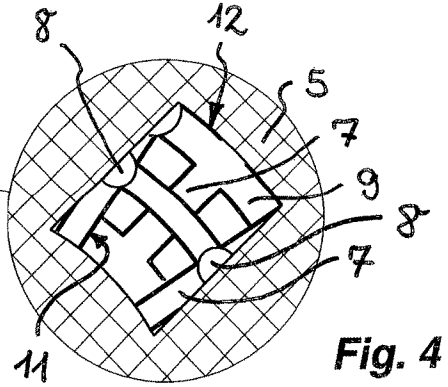
FIG. 4 shows a detail of the cross-sectional illustration shown in FIG. 3 in the region of a throughflow hole of the transversely sectioned perforated plate.

In FIGS. 3 and 4, it can be seen by way of example that at least one throughflow hole 6 and preferably all of the throughflow holes 6 is/are aligned, in the flow direction, with a radial web 7 of one mesh structure, in this case of the mesh structure that is downstream in the flow direction, and with a concentric web 9 of an adjacent mesh structure, in this case of the mesh structure arranged at the inflow side. The webs 7, 9 which are each aligned with one of the throughflow holes 6 overlap or intersect here, in a central or middle region of the associated throughflow hole 6, in the different planes of said mesh structures.

Figure 2:
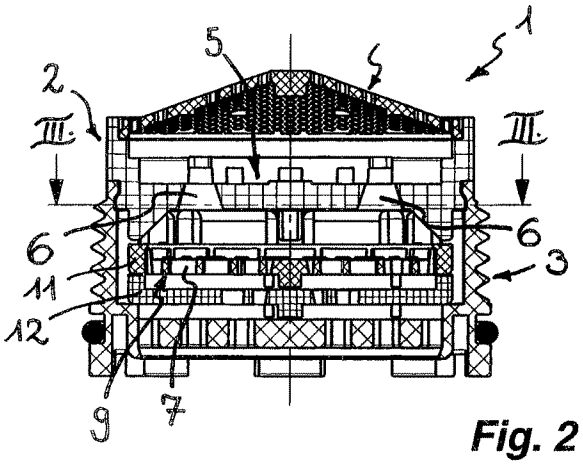
FIG. 2 shows the jet regulator from FIG. 1 in a longitudinal section, wherein it is possible in the housing interior of the jet regulator housing to see a perforated plate which is integrally connected to an inflow-side housing part and which bears throughflow holes which widen in a tapered or conical manner toward the outflow side of the perforated plate.
Figure 5:
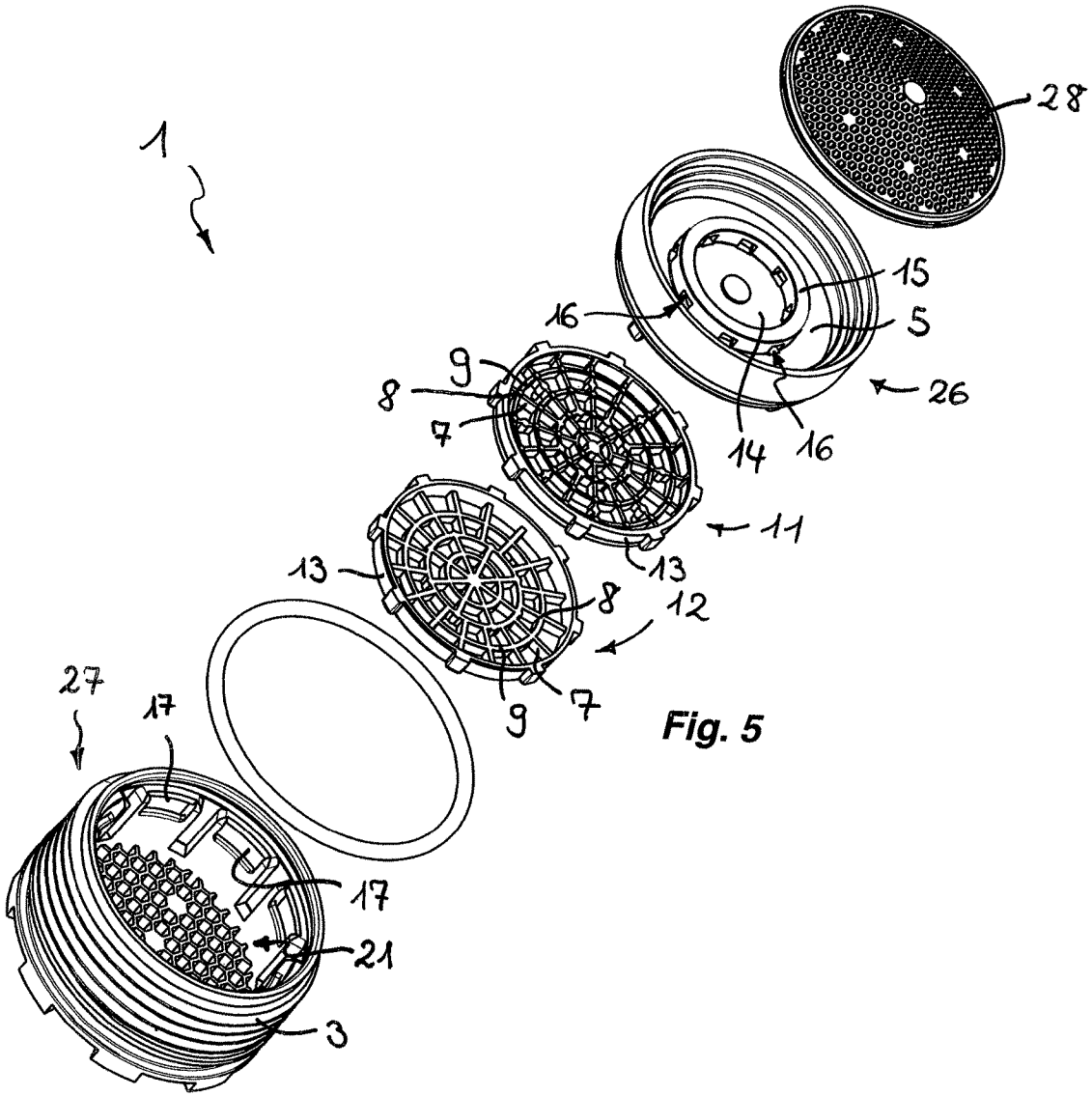
FIG. 5 shows the jet regulator from FIGS. 1 to 4 in an exploded perspective illustration of its individual parts.
Figure 6:
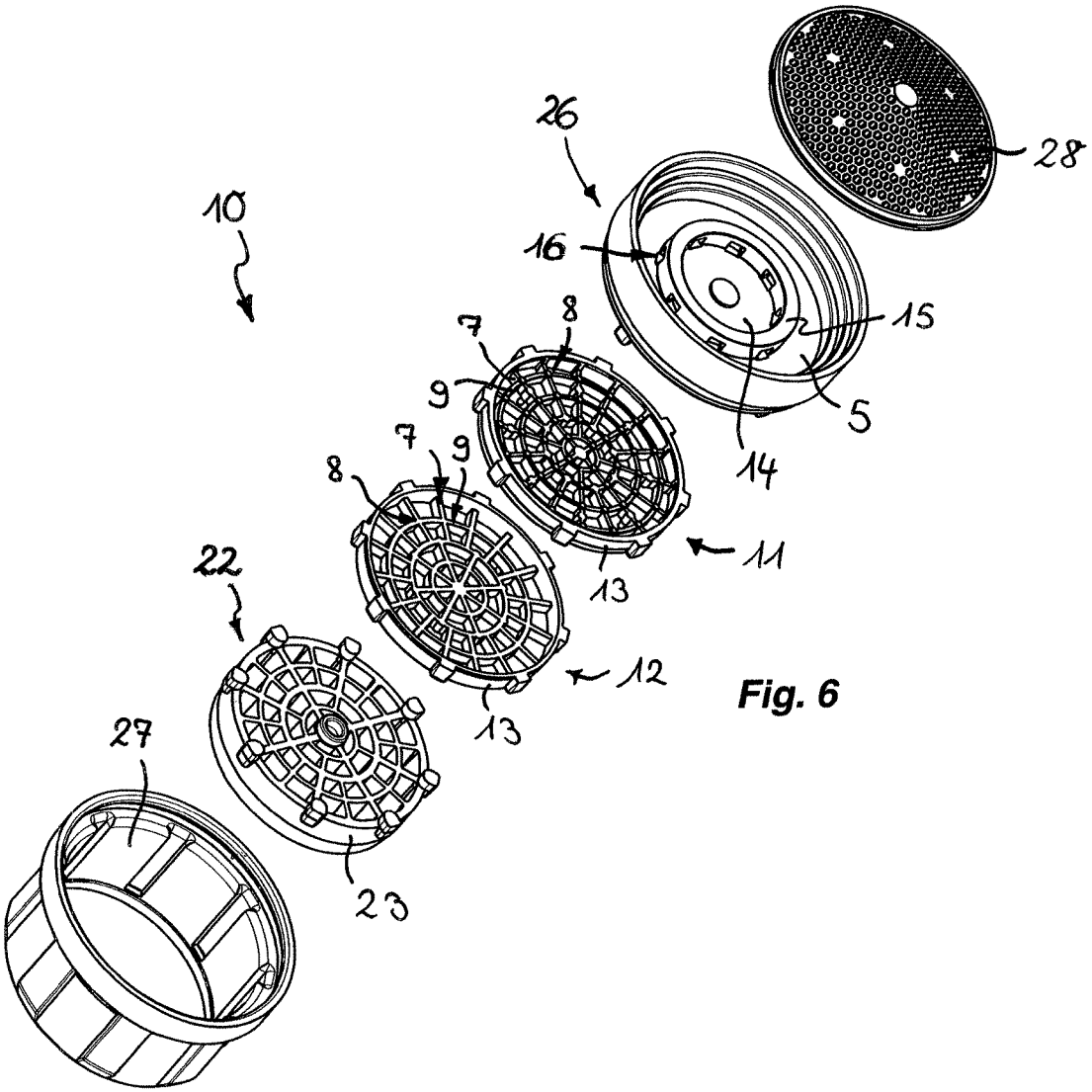
FIG. 6 shows a jet regulator of similar design to the jet regulator as per FIGS. 1 to 5, wherein the jet regulator shown in FIG. 6 can be mounted on the water outlet of a sanitary outlet fitting with the aid of an outlet mouthpiece not shown in any more detail here, and wherein the outflow-side face surface of the jet regulator shown in FIG. 6 is formed by an insert part which can be inserted into the jet regulator housing and which has a mesh structure.
Figure 8:
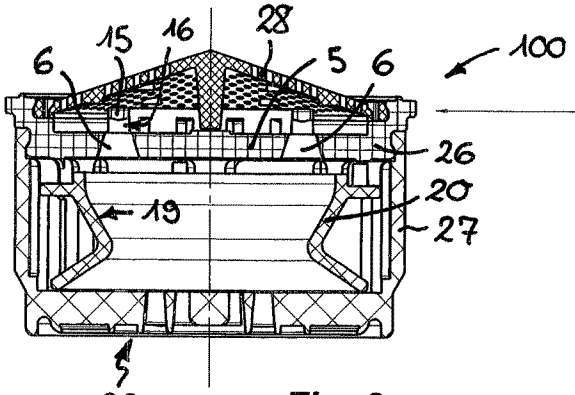
FIG. 8 shows the jet regulator from FIG. 7 in a longitudinal section through section plane VIII-VIII from FIG. 7, wherein it can be seen that the jet regulator shown in FIG. 8 has an impingement bevel which is spaced apart from the outflow side of the perforated plate and which forms a constriction that narrows the clear throughflow cross section of the jet regulator in the flow direction.
Figure 9:
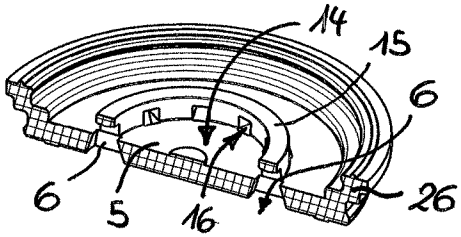
FIG. 9 shows the perforated plate of the jet regulator shown in FIGS. 7 and 8 in a perspective partial longitudinal section.

From a comparison of FIGS. 2, 5 and 6, it is clear that each of the mesh structures, which together form a jet regulating device, is formed by an insert part 11, 12 that can be inserted into the housing interior of the jet regulator housing 2. Here, each of said insert parts 11, 12 has, on the outer circumference, an encircling annular wall 13, wherein the radial webs 7, which intersect the concentric webs 9, of the mesh structure are connected to, and in this case formed integrally with, said encircling annular wall.

It can be seen particularly clearly from FIG. 4 that at least the concentric webs 9 and preferably also the radial webs 7 of a mesh structure positioned upstream as viewed in the flow direction have a greater web thickness than the webs 9, 7 of a mesh structure situated adjacently at the outflow side as viewed in the flow direction. In this way, as viewed in the throughflow direction, each throughflow hole 6 in the perforated plate 5 appears to split up into a multiplicity of further, smaller throughflow openings.

From a comparison of FIGS. 2, 5, 6, 8 and 9, it can be seen that the perforated plates 2 provided in the jet regulator embodiments 1, 10, 100 have a central impingement surface 14 which is bordered by at least one annular wall 15 protruding from an inflow side of the perforated plate that defines an internal annular housing. This annular wall 15 has passage openings 16 which are oriented in the radial direction and which, in this case, are arranged spaced apart from one another around the circumference of the annular wall 15. A respective one of the throughflow holes 6 of the perforated plate 2 is provided at the base side, and thus on the side arranged in the impingement surface plane, of the passage openings 16. As a result of this diversion of the in-flowing water in the region of the throughflow holes 6, the water is slowed, diverted to the side and possibly mixed by way of partial flows flowing toward one another in opposite directions, before said water is subsequently subjected to an increase in speed again due to the constriction of the throughflow cross section in the throughflow holes 6. In accordance with the Bernoulli equation, this speed increase results in a negative pressure being generated on the outflow side of the perforated plate 5, by means of which negative pressure ambient air can be drawn into the housing interior of the jet regulator housing 2. For this purpose, in the housing circumferential wall of the jet regulator housing 2, there is provided at least one aeration opening 17 which opens into the housing interior on the outflow side of the perforated plate 5. Outside the central impingement surface 14 there may be provided at least one further impingement surface 29, which in this case is of encircling form at the outside and which is preferably arranged in the plane of the central impingement surface 14.

Whereas the at least one aeration opening 17 in the jet regulator embodiment 1 shown in FIGS. 1 to 5 is in this case connected to the atmosphere via a double-walled section 18 of the housing circumferential wall on the outflow side of the jet regulator 1, it is the case in the jet regulator embodiments 10, 100 shown in FIGS. 6 to 13 that the aeration openings 17 extend through the jet regulator housing 2 in the radial direction and are connected, on the outside of the jet regulator housing 2, to an aeration duct which is in the form of an annular gap between the housing outer circumference of the jet regulator housing 2 and the inner circumference of the outlet mouthpiece and which is open to the atmosphere at the outflow-side face side of the outlet mouthpiece and jet regulator 10, 100.

Instead of the insert parts 11, 12, the jet regulator embodiment 100 shown in FIGS. 7 to 13 has, on the outflow side of the perforated plate 2 and at a distance from the latter, an encircling impingement bevel 19 on the housing inner circumference, which impingement bevel narrows the clear housing cross section in said region progressively in the flow direction. This impingement bevel 19 is formed by the inflow side of a wall section formed as a constriction which undulates as viewed in longitudinal section. The wall section that has the impingement bevel 19 is in this case in the form of an annular or sleeve-shaped insert part 20 that can be inserted into the jet regulator housing 2.

Figure 10:
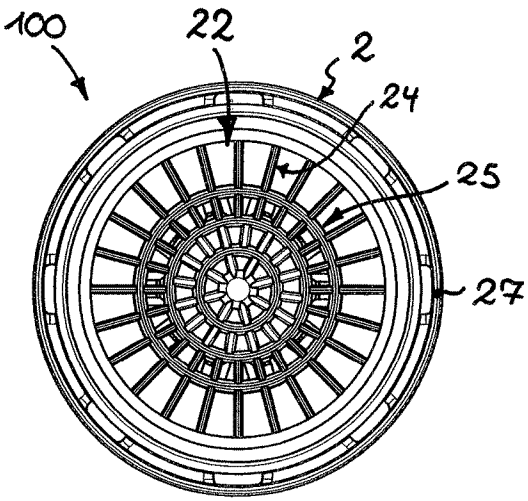
FIG. 10 shows the outflow-side face surface of the jet regulator shown in FIGS. 7 to 9 in a view from below.
Figure 7:
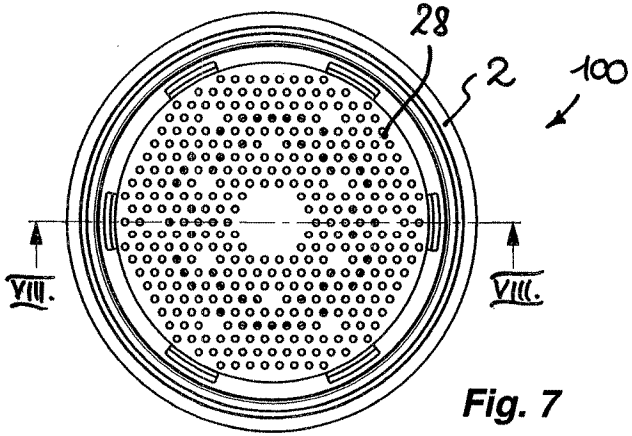
FIG. 7 shows the inflow-side view of a further jet regulator, wherein said inflow-side view shows primarily an upstream or filter screen positioned upstream of the jet regulator at the inflow side.
Figure 11:
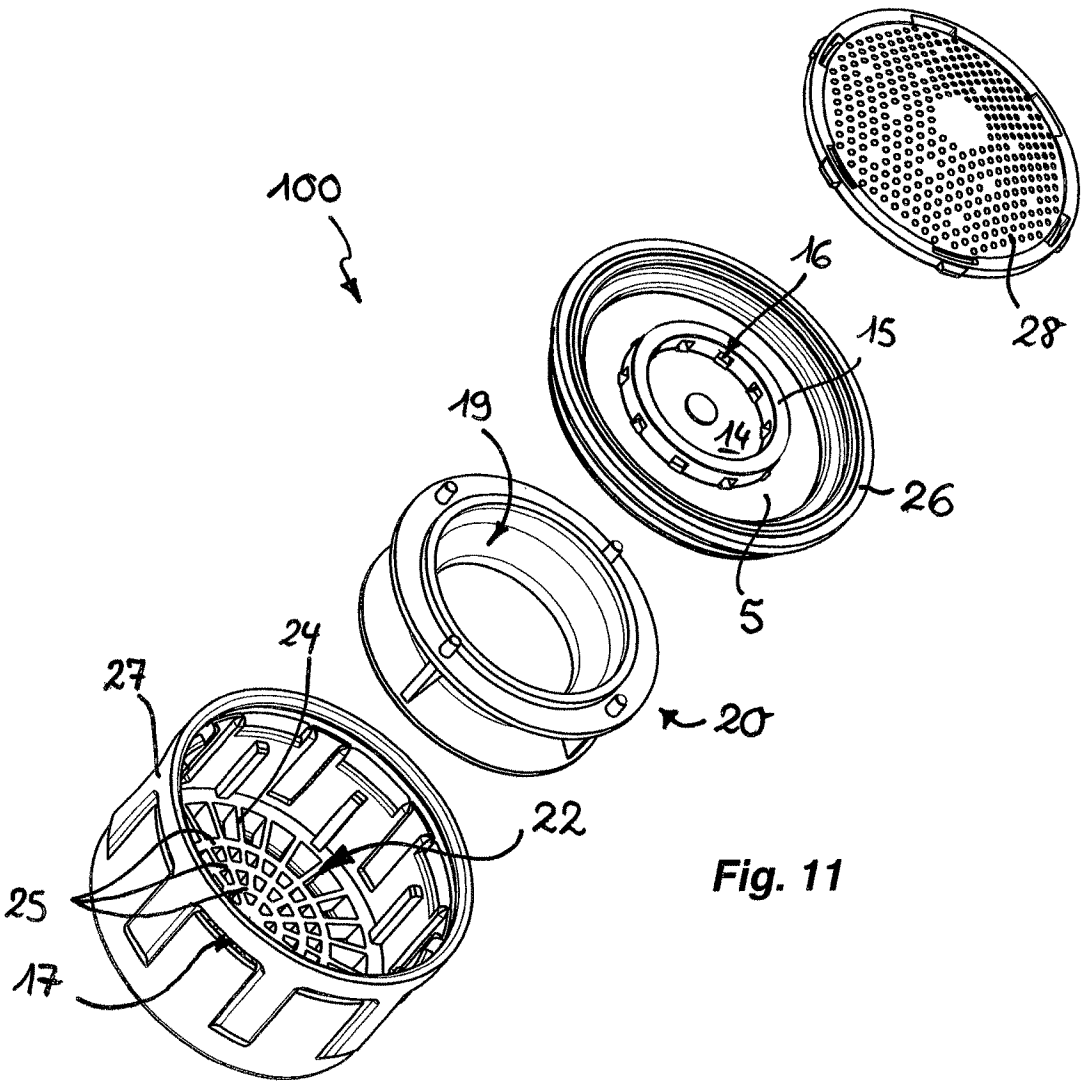
FIG. 11 shows the jet regulator as per FIGS. 7 to 10 in an exploded perspective illustration of its individual parts.
Figure 12:
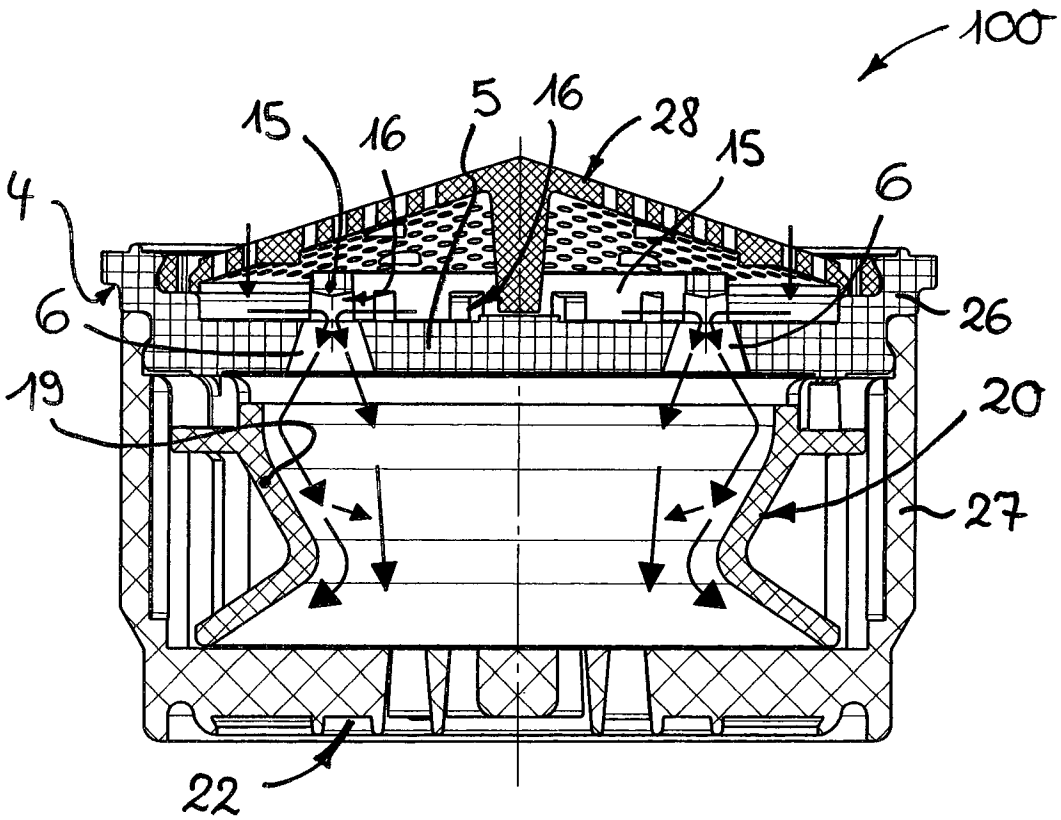
FIG. 12 shows the jet regulator from FIGS. 7 to 11 in an enlarged longitudinal section, wherein the flow direction of the water—flowing through the jet regulator is indicated by corresponding arrows.
Figure 13:
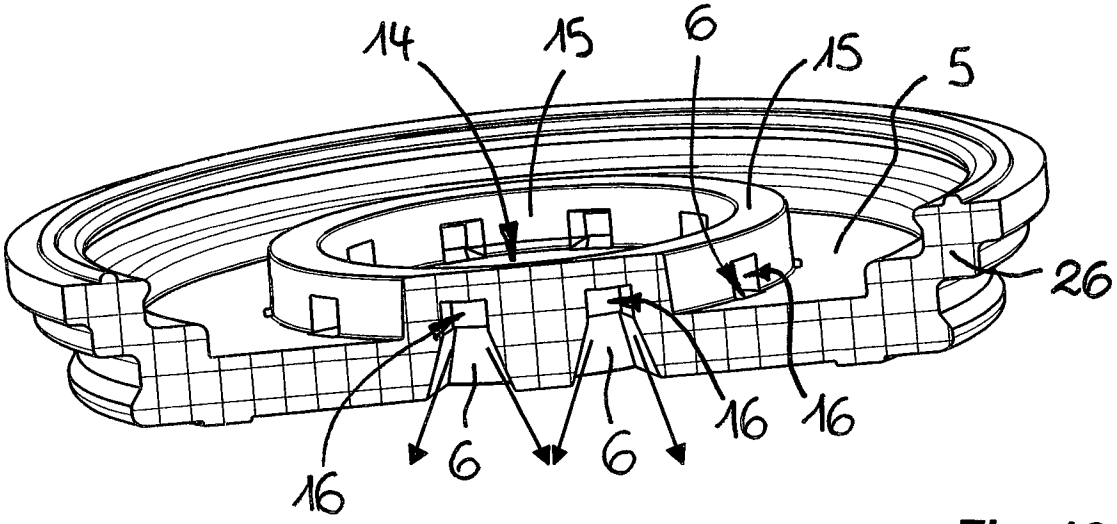
FIG. 13 shows, in an enlarged perspective partial longitudinal section, the perforated plate of the jet regulator shown in FIGS. 7 to 12.

From a comparison of FIGS. 6 and 11, on the one hand, and FIG. 5, on the other hand, it is clear that the outflow-side face surface of the jet regulators 1, 10, 100 is formed by a mesh structure 22 or a honeycomb structure 21. Whereas the mesh or honeycomb structure 22, 21 that forms the outflow-side face surface of the jet regulators 1, 100 is non-detachably connected to the jet regulator housing 2, the outlet structure 22 of the jet regulator 10 shown in FIG. 6 is formed by an insert part 23 that can be inserted into the jet regulator housing 2. From a comparison of FIGS. 8 and 10, it can be seen that the mesh structure 22 that forms the outflow-side face surface of the jet regulator 100 is formed by radial and concentric webs 24, 25 which narrow in the flow direction at least in an outflow-side sub-region. Homogenisation of the water emerging from the jet regulator housing 2 through the mesh structure so as to form a homogenous overall jet is additionally promoted by virtue of said webs 24, 25 narrowing in the flow direction at least in an outflow-side sub-region.

In FIGS. 10 and 11, it is clear that, on the outflow side of the perforated plate, flow obstructions may be provided in the jet regulator housing and/or—as is the case here—on the outflow face surface of the jet regulator housing 2, which flow obstructions are arranged or concentrated there in a central or middle region and divert the through-flowing water into an outer annular zone which, by contrast, has no flow obstructions or a smaller number or total area of flow obstructions. In the case of the jet regulator 100 shown in FIGS. 10 and 11, said flow obstructions are formed by the concentric webs 25 which, on the outflow face surface of the jet regulator housing 2, are concentrated in a central or middle region, whereas an outer annular zone is free from such concentric webs.

In FIGS. 5, 6 and 11, it is clear that the jet regulator housing 2 is formed in this case by two housing parts 26, 27 which are detachably connectable to one another and preferably lockable to one another and of which in this case the housing part 26, which is upstream at the inflow side, is connected integrally to the perforated plate 6. In order that any dirt particles entrained in the water cannot impair the correct functioning of the jet regulator, an upstream or filter screen 28 is positioned upstream of the jet regulator housing 2, which upstream or filter screen is in this case held detachably on the inflow-side housing part 26. This upstream or filter screen 28 has a multiplicity of filter or screen openings which are circular or polygonal, and in particular hexagonal, in cross section.

LIST OF REFERENCE SIGNS

1 Jet regulator (as per FIGS. 1 to 5)
2 Jet regulator housing
3 External thread
4 Annular shoulder
5 Perforated plate
6 Throughflow holes (in the perforated plate 5)
7 (Radial) webs
8 Intersection nodes
9 (Concentric) webs
10 Jet regulator (as per FIG. 6)
11 (Inflow-side) insert part
12 (Outflow-side) insert part
13 Annular wall (on the insert parts 11, 12)
14 Impingement surface (centrally on the perforated plate 5)
15 Annular wall (on the inflow side on the perforated plate 5)
16 Passage openings (in the annular wall 15)
17 Aeration opening (in the jet regulator housing 2)
18 (Double-wall) section (of the housing circumferential wall)
19 Impingement bevel
20 Insert part (with impingement bevel 19)
21 Honeycomb structure (as outflow-side face surface of the jet regulator)
22 Mesh structure (as outflow-side face surface of the jet regulator)
23 Insert part (as outflow-side face surface of the jet regulator 10)
24 (Radial) webs (of the outflow-side face surface of the jet regulator 100)
25 (Concentric) webs (on the outflow-side face surface of the jet regulator 100)
26 (Inflow-side) housing part
27 (Outflow-side) housing part
28 Upstream or filter screen
29 (Externally encircling) impingement surface (of the perforated plate 5)
100 Jet regulator (as per FIGS. 7 to 13)

The invention claimed is:

1. A jet regulator (1, 10, 100) comprising a jet regulator housing (2), in a housing interior of which there is provided a perforated plate (5) which has a multiplicity of throughflow holes (6) for dividing water flowing therethrough in a flow direction, at least one of the throughflow holes (6), at least in an outflow-side hole section, widens in a tapered or conical manner toward an outflow side thereof, the perforated plate (5) has a central, hole-free impingement surface (14) which is bordered by at least one annular wall (15) protruding from an inflow side of the perforated plate that defines an internal annular housing, the internal annular housing has passage openings (16) oriented in a radial direction defined therethrough, and in each case one of the throughflow holes (6) of the perforated plate (5) is provided beneath the internal annular housing in a throughflow direction on that side of the passage openings (16) which is arranged in an impingement surface plane, and the perforated plate (5) further includes an outer impingement surface located radially outwardly from the at least one annular wall (15) and both the central hole-free impingement surface (14) as well as the outer impingement surface are open to an inlet side of the housing such that an incoming flow of water is adapted to flow on both sides of the at least one annular wall (15) through the passage openings (16) that are oriented in a radial direction and into the throughflow holes (6).

2. The jet regulator as claimed in claim 1, wherein at least one of the throughflow holes (6), at least in the outflow-side hole section, that widens in the tapered or conical manner toward the outflow side widens such that an individual jet or spray jet which emerges from the throughflow hole (6), and which widens due to the tapered shape or conicity, mixes in the housing interior with the individual jet of at least one adjacent one of the throughflow holes (6).

3. The jet regulator (100) as claimed in claim 1, wherein on the outflow side of the perforated plate (5), flow obstructions are provided in at least one of the jet regulator housing (2) or on an outflow face surface of the jet regulator housing (2), said flow obstructions are arranged in a middle region beneath each of the throughflow holes (6) and divert the through-flowing water into an outer annular zone.

4. The jet regulator as claimed in claim 1, wherein on the outflow side of the perforated plate (5) and at a distance therefrom, there is an encircling impingement bevel (19) which narrows a clear housing cross section in said region progressively in the flow direction.

5. The jet regulator as claimed in claim 4, wherein the impingement bevel (19) forms an inflow side of a wall section which is formed as at least one constriction which undulates as viewed in a longitudinal section.

6. The jet regulator as claimed in claim 4, wherein the jet regulator housing (2) is of multi-part form and has at least two housing parts (26, 27) which are connectable to one another.

7. The jet regulator as claimed in claim 6, wherein at least one of the impingement bevel (19) is formed integrally on a housing inner circumference of an outflow-side one of the housing parts (27) or the perforated plate (5) is formed integrally in a housing interior of an inflow-side one of the housing parts (26).

8. The jet regulator as claimed in claim 1, wherein at least one mesh or grate structure is positioned downstream of the perforated plate (5) as viewed in the flow direction.

9. The jet regulator as claimed in claim 8, wherein the mesh or grate structure is formed from two sets of webs (7, 9) which intersect one another at intersection nodes (8).

10. The jet regulator as claimed in claim 9, wherein the mesh structure is formed from radial webs (7) and from concentric webs (9) which intersect said radial webs at the intersection nodes (8).

11. The jet regulator as claimed in claim 9, wherein there are at least two of the mesh or grate structures which are spaced apart from one another are positioned downstream of the perforated plate (5) as viewed in the flow direction.

12. The jet regulator as claimed in claim 11, wherein at least one of the throughflow holes (6) is aligned, in the flow direction, with a radial web (7) of one of the mesh structures.

13. The jet regulator as claimed in claim 12, wherein the webs (7, 8) that are aligned in each case with one of the throughflow holes (6) overlap or intersect, in the flow direction of the at least one of the throughflow holes (6), in different planes of said mesh structures.

14. The jet regulator as claimed in claim 11, wherein each of the mesh structure is formed by an insert part (11, 12) that is insertable into the housing interior of the jet regulator housing (2).

15. The jet regulator as claimed in claim 14, wherein each of the insert parts (11, 12) has, on an outer circumference, an encircling annular wall (13) to which said webs (7) of the mesh or grate structure are connected.

16. The jet regulator as claimed in claim 10, wherein there are at least two of the mesh or grate structures, and at least the concentric webs (9) of an upstream one of the mesh structures as viewed in the flow direction has an identical or smaller web thickness in relation to the webs (7, 9) of one of the mesh structures which is adjacent at the outflow side as viewed in the flow direction.

17. The jet regulator as claimed in claim 1, wherein the internal annular housing is bordered, on an outer circumference, by an encircling hole-free impingement surface (29).

18. The jet regulator as claimed in claim 1, wherein an outflow-side face surface of the jet regulator housing (2) is formed by a mesh or honeycomb structure (21; 22), and the mesh or honeycomb structure (21; 22) that forms the outflow-side face surface is either non-detachably connected to the jet regulator housing (2) or formed by an insert part (23) that is inserted into the jet regulator housing (2).

19. The jet regulator as claimed in claim 18, wherein the mesh or honeycomb structure (21; 22) that forms the outflow-side face surface of the jet regulator housing (2) is formed by webs (24, 25) which, at least in an outflow-side sub-region, narrow in the flow direction.

20. The jet regulator as claimed in claim 1, wherein the jet regulator (1, 10, 100) is an aerated jet regulator which has at least one aeration opening (17) which issues into the housing interior on the outflow side of the perforated plate (5) and connects the housing interior to atmosphere.

* * * * *